US005682653A

United States Patent [19]

Berglöf et al.

[11] Patent Number: 5,682,653

[45] Date of Patent: Nov. 4, 1997

[54] MAGNETIC FASTENING DEVICE

[76] Inventors: Fredrik Berglöf, Trastbacken 3, S-163 54 Spånga; Patrik Berglöf, Ellakrogsvägen 36, S-183 46 Täby, both of Sweden

[21] Appl. No.: 522,413

[22] PCT Filed: Mar. 25, 1994

[86] PCT No.: PCT/SE94/00273

§ 371 Date: Nov. 6, 1995

§ 102(e) Date: Nov. 6, 1995

[87] PCT Pub. No.: WO94/23409

PCT Pub. Date: Oct. 13, 1994

[30] Foreign Application Priority Data

Mar. 26, 1993 [SE] Sweden ..... 9301011

[51] Int. Cl.[6] ..... A44B 21/00

[52] U.S. Cl. ..... 24/303; 224/183; 24/DIG. 29

[58] Field of Search ..... 24/303; 224/183; 335/285, 303; 248/206.5, 309.4; 40/1.5, 600, 621

[56] References Cited

U.S. PATENT DOCUMENTS

| | | | |
|---|---|---|---|
| 3,529,328 | 9/1970 | Davidson | 24/303 |
| 3,741,376 | 6/1973 | Brown et al. | 224/183 X |
| 3,744,542 | 7/1973 | Stephens et al. | 224/183 X |
| 3,755,857 | 9/1973 | Simoneaux | 24/303 |
| 4,255,837 | 3/1981 | Holtz | 24/303 |
| 4,258,493 | 3/1981 | Kettlestrings et al. | 40/600 |
| 4,336,806 | 6/1982 | Eldridge, Jr. | 24/303 X |
| 4,447,238 | 5/1984 | Eldridge, Jr. | 24/303 X |
| 4,588,209 | 5/1986 | Zebrowski et al. | 24/303 X |
| 5,186,373 | 2/1993 | Taylor | 24/303 X |
| 5,196,818 | 3/1993 | Anderson | 224/183 X |
| 5,369,899 | 12/1994 | Reeves | 24/303 X |
| 5,425,160 | 6/1995 | Krapf | 24/303 X |
| 5,450,658 | 9/1995 | Hicks | 24/303 |

FOREIGN PATENT DOCUMENTS

| | | |
|---|---|---|
| 0029500 | 6/1981 | European Pat. Off. . |
| 453620 | 2/1988 | Sweden . |
| 459830 | 8/1989 | Sweden . |

*Primary Examiner*—Peter M. Cuomo
*Assistant Examiner*—Robert J. Sandy
*Attorney, Agent, or Firm*—Andrus, Sceales, Starke & Sawall

[57] ABSTRACT

A magnetic fastening device comprises a magnetic attraction member (11, 12) including a permanent magnet (16, 17) and an elongate tubular sheath (13) which is made of nonmagnetic material and tightly encloses the magnetic attraction member (12, 13). Two magnetic attraction members may be interconnected by a flexible hinge member which is integral with the sheaths of the members and formed from a length (13) of shrink tubing.

7 Claims, 1 Drawing Sheet

MAGNETIC FASTENING DEVICE

Figure 1:
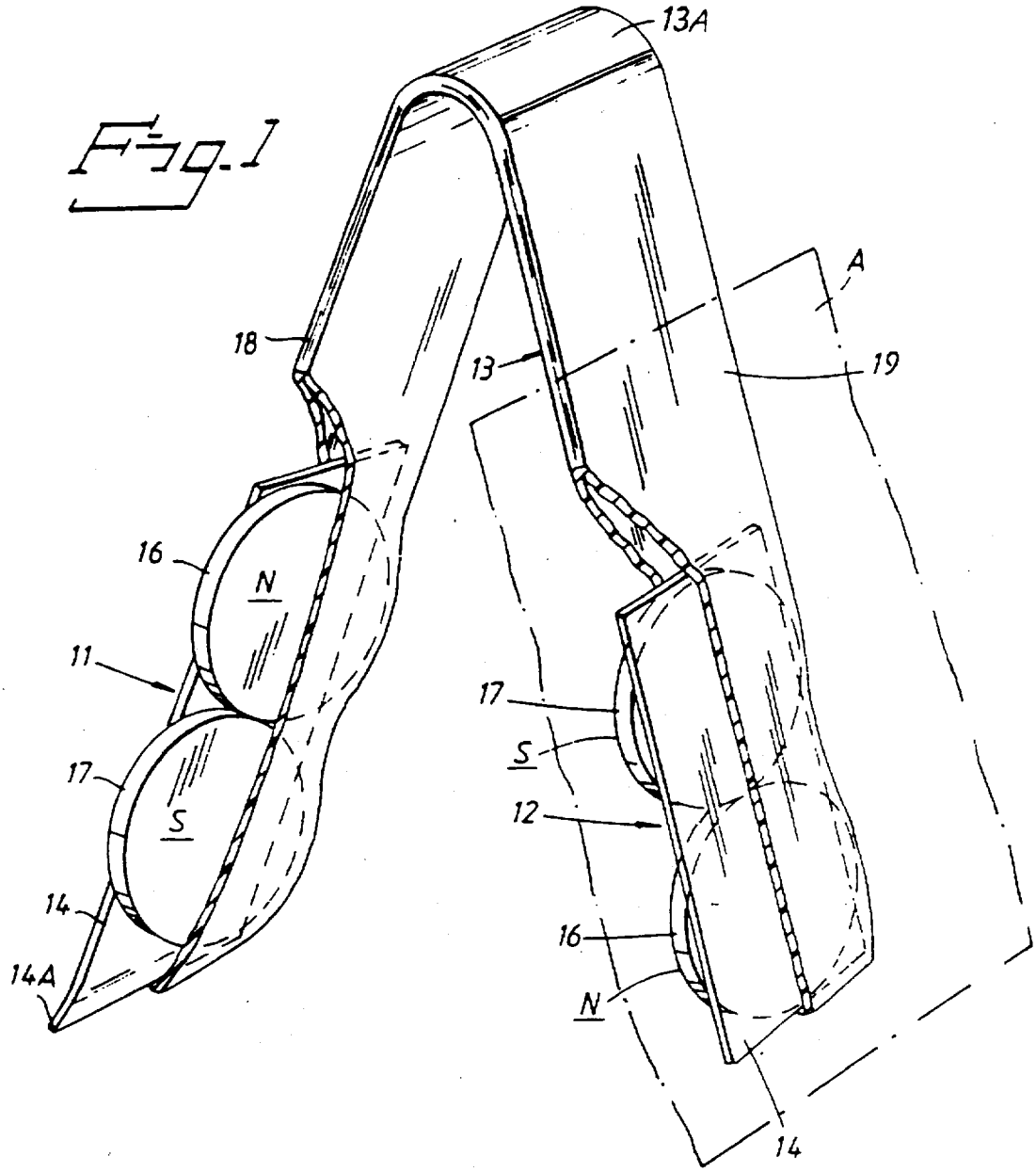

This invention relates to magnetic fastening devices of the kind having two magnetic attraction members which attract one another magnetically through an interposed object, which may be an object to be held by the device or an object to which the device is to be held.

In particular, but not exclusively, the invention relates to a fastening device of the kind comprising two magnetically attractive cooperating limbs which are interconnected by a hinge member, at least one of the limbs comprising a magnetic attraction member, the magnetic attraction member of at least one limb comprising a permanent magnet.

Examples of fastening devices of this kind are disclosed in SE-B-453 620, U.S Pat. No. 4,258,493 and EP-A-0 029 500. The first-mentioned patent publication discloses a fastening device in which the hinge member is a ligament in the shape of a short flexible plastic strip the ends of which are attached to the peripheral portions of a pair of flat circular permanent magnets. U.S. Pat. No. 4,258,953 shows a similar fastening device. EP-A-0 029 500 shows a fastening device in which the hinge member includes a hinge pin which is attached to one of the limbs and journalled in the other limb.

An object of the invention is to provide a fastening device of the aforesaid kind which can be produced in a simple and economical manner.

It is also an object of the invention to provide a magnetic fastening device which can efficiently utilize the magnetism of the permanent magnet or magnets so that a strong holding power can be attained with small-sized and hence lightweight permanent magnets.

Low weight is particularly important if the fastening device is used for name tags, campaign buttons and similar objects attached to articles of clothing.

According to one aspect of the invention there is provided a fastening device of the kind comprising two magnetically attractive cooperating limbs which are interconnected by a hinge member, each limb including a magnetic attraction member, the magnetic attraction member of at least one of the limbs comprising a permanent magnet, wherein the hinge member forms an elongate tubular sheath which is made of nonmagnetic material and tightly encloses the magnetic attraction members of both limbs.

According to another aspect of the invention there is provided a fastening device of the kind comprising two magnetic attraction members, at least one of the magnetic attraction members comprising a permanent magnet, wherein at least said one magnetic attraction member is tightly enclosed by a tubular sheath of nonmagnetic material.

According to a further aspect of the invention there is provided a magnetic fastening device comprising a magnetic attraction member including a backing plate of magnetically soft material and at least one permanent magnet body assembled with the backing plate so as to engage one face of the backing plate, and a tubular sheath of nonmagnetic material which tightly encloses the magnetic attraction member.

Figure 2:
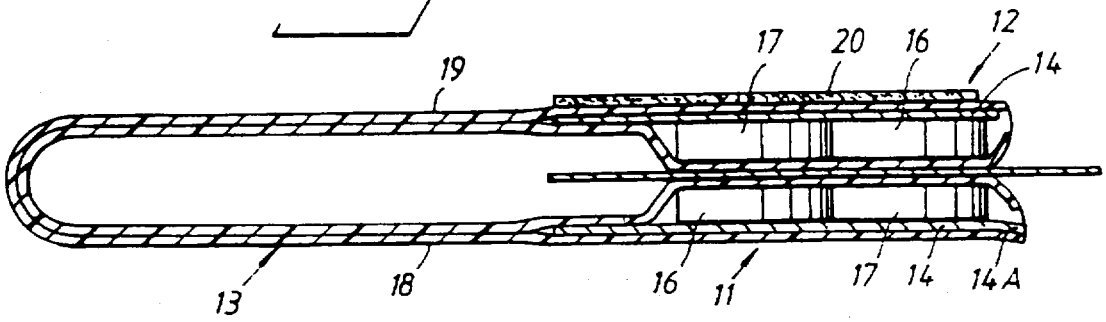

Other objects, features and advantages will become apparent from the following description of a representative exemplary embodiment shown in the accompanying drawing, in which:

FIG. 1 is a perspective view of a magnetic fastening device embodying the principles of the invention, the fastening device being illustrated in an open position with portions of the sheath being broken away; and FIG. 2 is a longitudinal sectional view of the fastening device in FIG. 1 shown in a closed or holding position with an object clamped between the opposed magnetic attraction members.

Referring to the drawing, the exemplary fastening device comprises two cooperating magnetic attraction members 11 and 12 and an elongate interconnecting member which forms a tubular sheath 13 that interconnects and tightly encloses the two members.

Each member 11, 12 comprises an assembly of an elongate rectangular pole-piece or backing plate 14 of a magnetically soft material and a pair of permanent magnets 16, 17 positioned on one face of the plate and being in the shape of thin flat circular discs of a diameter slightly larger than the width of the plate. The two magnets are placed side by side and immediately adjacent one another on the plate 14 and magnetized such that their poles are located on the opposite flat sides. Accordingly, one pole of each magnet 16, 17 contacts and faces the plate 14, whereas the other pole faces away from the plate, the north pole N of the magnet 16 and the south pole S of the magnet 17 facing away from the plate.

The elongate interconnecting member forming the sheath 13 is a length of plastic shrink tubing, i.e. a length of plastic tubing which contracts or shrinks when heated. The two magnetic attraction members 11, 12 are enclosed within the end portions of the plastic tubing and held securely in position therein as a consequence of the shrink tubing having been heated following the insertion of the members so that it firmly engages and tightly encloses the plate 14 and the magnets 16, 17.

Preferably, the portion of the shrink tubing which extends between the magnetic attraction members 11 and 12 is flattened to band or strip shape as shown in the drawing so that it can readily be bent to the illustrated U-shape. This flattening can be effected when the shrink tubing is heated to be contracted about the magnetic attraction members. At the same time, the flattened portion is folded over at the centre so that it is preformed to the illustrated shape with two limbs 18 and 19 of approximately the same length.

When the magnetic attraction members 11 and 12 are inserted in the end portions of the length of shrink tubing forming the sheath 13, they are oriented such that the magnet 17 of one member 11 and the magnet 16 of the other member 12 will be at the associated end of the tubing. Accordingly, when the limbs 18 and 19 are folded together about the central bend 13A to place the magnetic attraction members 11 and 12 in the aligned position shown in FIG. 2, poles of opposed polarities will face one another.

The fastening device can be used in many different ways and for different purposes. For example, it can be used a an attachment device for a name tag (such as indicated in phantom lines at A in FIG. 1) or the like. In such a case, one of the limbs, such as limb 19, is secured to the reverse side of the name tag in any suitable manner, such as by heat sealing or by means of a pressure sensitive adhesive; this adhesive may be applied to the limb by the manufacturer of the fastening device and covered by a protective sheet which is removed when the fastening device is secured to the name tag. A preapplied adhesive layer is shown at 20 in FIG. 2. The name tag may then be fastened to a lapel or other part of an article of clothing by bringing the limbs 18, 19 to a straddling position over the lapel and moving the limbs together against the lapel so that the magnetic attraction members 11 and 12 will clamp the lapel between them by their mutual magnetic attraction.

If it is desired to use a name tag or the like provided with the fastening device as illustrated in the drawing in a manner that is not permitted by the fastening device, e.g. in a position remote from the edge of a lapel, the interconnecting member forming the sheath 13 may be severed between the magnetic attraction members 11 and 12, so that the magnetic attraction members become detached from one another and can be brought to an opposing position anywhere on a garment to clamp the name tag to the garment.

Naturally, the fastening device may also be attached to walls, bulletin boards, vehicles etc. to serve as a holder for information or advertisement sheets or other objects.

In order that the limbs 18, 19 may be conveniently separated when opening the fastening device, the backing plate 14 of at least one of the magnetic attraction members 11, 12 is extended a short distance beyond the outermost magnet 16 or 17 to serve as a fingergrip. In the illustrated embodiment of the fastening device, such an extension 14A intended to serve as a fingergrip is provided on the backing plate 14 of the magnetic attraction member 11.

The length of the magnetic attraction members 11, 12 may be varied and adapted to the length of the limbs 18, 19 as desired, having regard to the intended application of the fastening device. Advantageously, the rigidity or flexibility of the portion of the sheath 13 which extends between the magnetic attraction members 11, 12 is selected such that these members tend naturally to adopt an aligned position when they are brought together, that is, without the user having to guide or control them in any special manner, so that the magnets of the magnetic attraction members of one limb will face the magnets of the magnetic attraction unit of the other limb across the interposed sheet, fabric or the like.

As is readily appreciated, the fastening device according to the invention has several advantages over the known magnetic fastening devices.

For example, in use of the fastening device the magnetic field produced by the permanent magnets is very weak in the region outside the magnetic attraction members, apart from the region between them, because on account of their high magnetic permeability, the backing plates 14 which convey the magnetic flux between the poles engaging the plates effectively prevent the magnetic flux from extending outwardly beyond the reverse side of the backing plates.

Persons using a pacemaker can therefore use name tags provided with the fastening device according to the invention without exposing themselves to danger resulting from the magnets. Moreover, the limitation of the magnetic field to the magnetic attraction members greatly reduces the danger of the fastening device damaging magnetically recorded information on credit cards, computer diskettes etc.

It should also be noted that there is no need to secure the magnets 16, 17 to the backing plates 14 using adhesive or the like before the members are inserted in the shrink tubing, because the magnetic attraction between the magnets and the backing plate will suffice to hold the magnets firmly to the backing plate.

The invention is not limited to magnetic fastening devices in which there are two magnetic attraction members or assemblies which are held together by an interconnecting member as shown in the drawing. It is thus within the scope of the invention to provide a magnetic fastening device which comprises at least one magnetic attraction member of the kind described which can be used as one of a pair of magnetic attraction members to clamp an interposed object, the other magnetic attraction member not necessarily having to be provided with a permanent magnet or magnets.

We claim:

1. A fastening device comprising two magnetically attractive cooperating limbs (18, 19) which are interconnected by a hinge member (13), each limb including a magnetic attraction member (11, 12), the magnetic attraction member of at least one of the limbs comprising a permanent magnet (16, 17), characterized in that the hinge member (13) forms an elongate tubular sheath which is made of nonmagnetic material and tightly encloses the magnetic attraction members (12, 13) of both limbs, and at least one of the magnetic attraction members (11, 12) comprises a backing plate (14) of magnetically soft material and at least one permanent magnet (16, 17) assembled with the backing plate so as to engage one face of the backing plate.

2. A fastening device according to claim 1, characterised in that the tubular sheath (13) is formed from a length of shrink tubing and in that the magnetic attraction members (11,12) are spaced apart longitudinally of the tubular sheath, the sheath being flattened over a portion of its length between the magnetic attraction members.

3. A fastening device according to claim 1, characterised in that at least two disc-like permanent magnets (16,17) are assembled with said face of the backing plate (14) and positioned adjacent to one another in the longitudinal direction of the tubular sheath (13), the north and south poles (N,S) of each permanent magnet (17) being positioned respectively at the side of the permanent magnet facing the backing plate (14) and at the side facing away from the backing plate, adjacent permanent magnets having opposite polarities at the respective sides facing away from the backing plate.

4. A fastening device comprising two magnetic attraction members (11,12), at least one of the magnetic attraction members comprising a permanent magnet (16, 17), characterized in that at least said one magnetic attraction member (11,12) is tightly enclosed by a tubular sheath (13) of nonmagnetic material, and at least one of the magnetic attraction members (11,12) comprises a backing plate (14) of magnetically soft material and at least one permanent magnet (16, 17) assembled with the backing plate so as to engage one side of the backing plate.

5. A fastening device according to claim 4, characterised in that the sheath (13) is formed from a length of shrink tubing.

6. A fastening device according to claim 4, characterised in that at least two disc-like permanent magnets (16,17) are assembled with said face of the backing plate (14) and disposed adjacent to one another, the north and south poles (N,S) of each permanent magnet being located respectively at the side of the permanent magnet facing the backing plate (14) and at the side facing away from the backing plate, adjacent permanent magnets (16, 17) having opposite polarities at the respective sides facing away from the backing plate.

7. A magnetic fastening device comprising a magnetic attraction member including a backing plate (14) of magnetically soft material and at least one permanent magnet (16, 17) assembled with the backing plate so as to engage one face of the backing plate, and a tubular sheath (13) of nonmagnetic material which tightly encloses the magnetic attraction member (14, 16, 17), and the tubular sheath (13) is formed from a length of shrink tubing.

* * * * *